US005085298A

United States Patent [19]

Sollami

[11] Patent Number: 5,085,298

[45] Date of Patent: Feb. 4, 1992

[54] PRESSURE COMPENSATING RELIEF AND REFILL SYSTEM

[76] Inventor: Phillip A. Sollami, 1300 E. Pine, Herrin, Ill. 62948

[21] Appl. No.: 579,737

[22] Filed: Sep. 10, 1990

[51] Int. Cl.[5] ..... F01C 9/00

[52] U.S. Cl. ..... 188/314; 188/306; 188/310; 188/315; 137/493.8; 138/31

[58] Field of Search ..... 137/493.8; 138/31; 188/306, 310, 314, 315; 92/125

[56] References Cited

U.S. PATENT DOCUMENTS

| | | | |
|---|---|---|---|
| 3,062,330 | 11/1962 | Lyon | 188/314 X |
| 4,061,320 | 12/1977 | Warner | 188/314 X |
| 4,695,226 | 9/1987 | Marchitto | 188/314 X |
| 4,823,678 | 4/1989 | Sollami | 92/125 |
| 4,941,554 | 7/1990 | Sollami | 188/314 X |

*Primary Examiner*—Robert G. Nilson
*Attorney, Agent, or Firm*—Edmond T. Patnaude

[57] ABSTRACT

There is disclosed a hydraulic fluid regulator for automatically supplying hydraulic fluid to the pressure chamber of a rotary torque resistance actuator to replace fluid which may move out of the pressure chamber of the actuator when the fluid is heated and expands. The regulator includes a pneumatically pressurized fluid supply reservoir connected to the pressure chamber in the actuator by two parallel conduits respectively having spring loaded check valves therein connected in opposite directions to supply fluid to the chamber when the pressure in the chamber falls below a preset value and to transmit fluid from the chamber to the reservoir when the pressure in the pressure chamber exceeds a different preset value. The reservoir also includes a third bypass conduit connected in parallel with the first two conduits for metering fluid from the actuator chamber when the fluid expands, and a filter is connected in line with the three conduits.

3 Claims, 2 Drawing Sheets

PRESSURE COMPENSATING RELIEF AND REFILL SYSTEM

The present invention relates in general to a hydraulic fluid regulator for use with a pressurized fluid system, and it relates in particular to a regulator for supplying hydraulic fluid to a hydraulic resistance device when the pressure therein falls below a first predetermined value and for transmitting hydraulic fluid from the device when the pressure therein exceeds a second predetermined value.

BACKGROUND OF THE INVENTION

Hydraulic torque resistance devices wherein hydraulic fluid is transferred from one chamber to another through an adjustable resistance are used in exercising equipment. One such device is disclosed in my patent 4,941,554. In that machine the torque resistance device includes a rotary vane which resists rotation of the shaft to which it is mounted by forcing hydraulic fluid from a chamber on one side of the vane to a chamber on the other side of the vane. When the shaft is rotated by the person doing the exercise, the fluid is heated and expands, and unless the expanded fluid is permitted to escape from the chambers, it will leak from the device. When the fluid subsequently cools and contracts, additional fluid must be supplied to the chambers to prevent voids from forming within the chambers with a resulting irregularity in the resistance to torque provided by the device.

SUMMARY OF THE INVENTION

Briefly, there is provided in accordance with the present invention a new and improved regulator for automatically maintaining the chamber in a torque resistance device filled with hydraulic fluid as the fluid in the device expands and contracts.

In a preferred embodiment, the regulator of the present invention incorporates a pneumatically pressurized hydraulic fluid reservoir connected to the pressure chamber in a torque resistance device by three parallel conduits and a filter. Oppositely oriented, spring loaded check valves are respectively positioned in two of the conduits while the third conduit, which functions as a constricted metering orifice for transferring small quantities of fluid between the reservoir chamber and the pressure chamber in the resistance device, is open at all times.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

Figure 1:
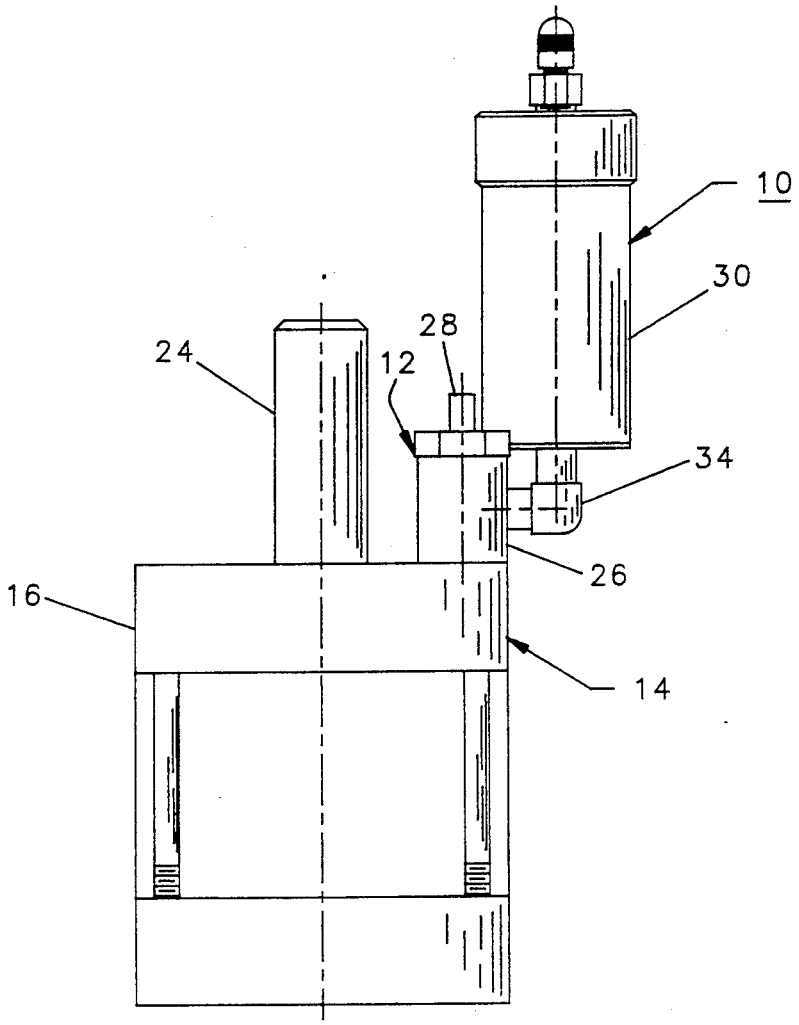
FIG. 1 is an elevational view of a torque resistance device to which is connected the pressure regulating reservoir of the present invention.
Figure 2:
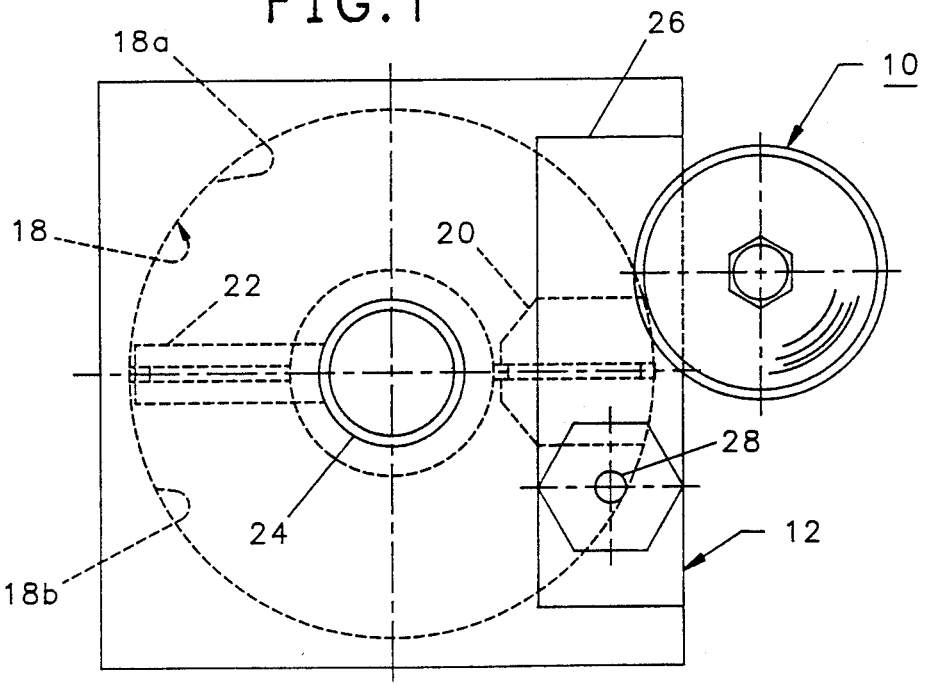
FIG. 2 is an enlarged top view of the assembly shown in FIG. 1.

Referring in particular to FIGS. 1 and 2, a pressure regulating relief and refill system 10 is connected to a manually adjustable fluid resistance device to the chambers in a hydraulic torque resistance device 14. The, device 14 is described more completely in U.S. Pat. No. 4,823,678, and includes a housing 16 enclosing a generally cylindrical bore divided into two pressure chambers 18*a* and 18*b* by a stator 20 and a radial vane 22 mounted to a rotatable shaft 24. Suitable bearings and seals are provided to prevent leakage of hydraulic fluid from one of the chambers 18*a*, 18*b* to the other and from the device itself. The chambers 18*a* and 18*b* are connected together by means of a passageway (not shown) in a block 26 so that as the shaft 24 is rotated in one direction or the other, the hydraulic fluid which fills the chambers 18*a* and 18*b* is forced by the vane 22 from one chamber to the other. An adjustable restriction (not shown) is provided in the passageway in the block 26 and is controlled by means of a shaft 28 which extends upwardly from the block 26 to adjust the torque required to rotate the shaft 24.

It is important that the chambers 18*a* and 18*b* be completely filled with hydraulic fluid at all times to insure a smooth rotation of the shaft 24 as torque is applied thereto. During use of the device in an exercise machine, the shaft is manually rotated, and heat is generated in the hydraulic fluid as it is transferred from one chamber to the other. This causes a rise in the temperature of the hydraulic fluid with a resultant increase in volume and pressure. Unless the increased pressure in the chambers 18*a* and 18*b* is relieved, the seals may be overloaded with a resultant leakage of fluid from one chamber to the other and from the device itself. On the other hand, it is important that there be no voids in the fluid in the chambers 18*a* and 18i the device 14 will not provide a constant and smooth resistance to the torque applied thereto.

Figure 3:
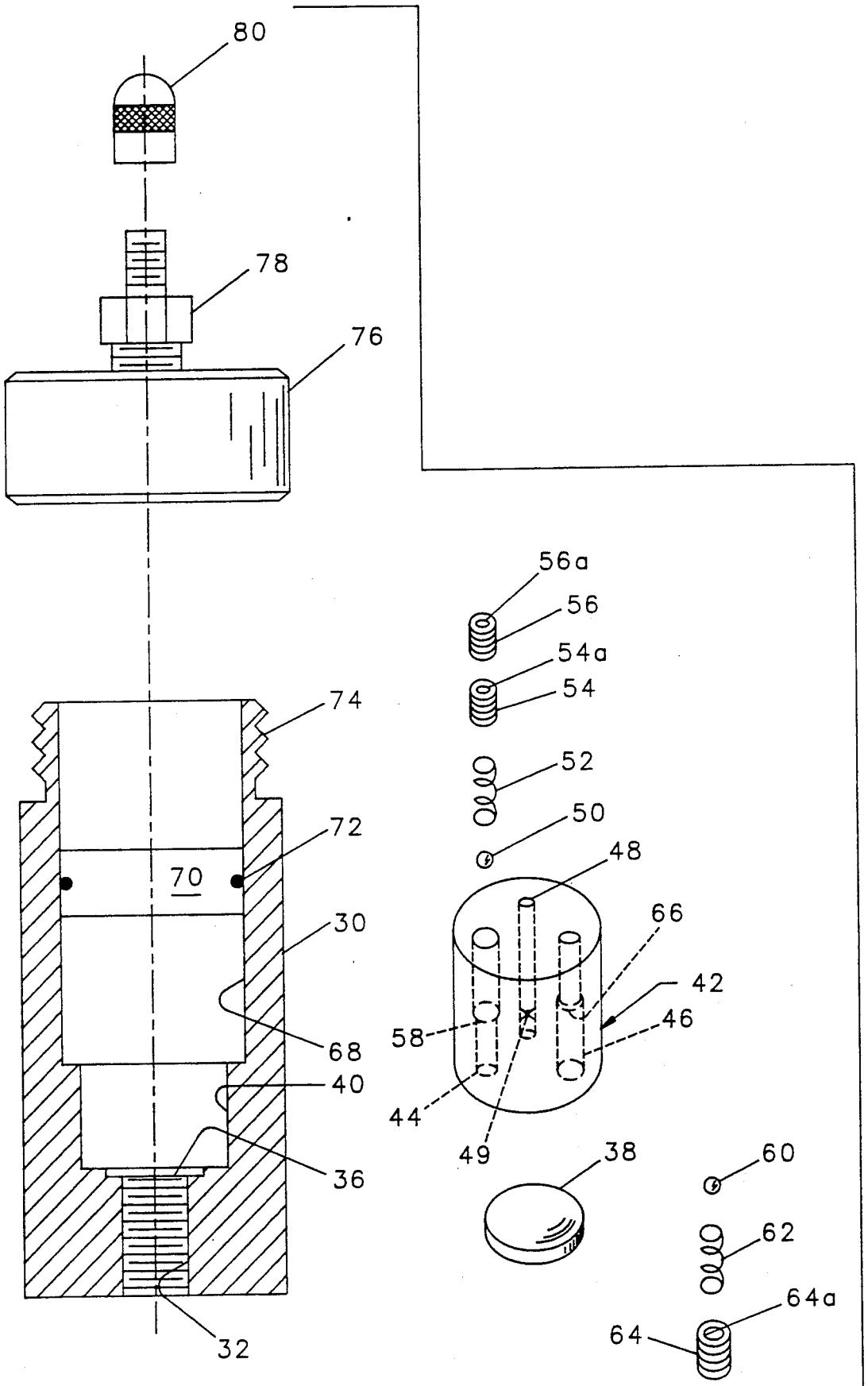
FIG. 3 is an exploded view, partially in section, of the pressure regulating reservoir shown in FIG. 1.

In accordance with the present invention, the pressure compensating relief and refill system 10 is provided for maintaining a substantially constant pressure within the chamber 18*a* and 18*b* while replacing any hydraulic fluid which may leak therefrom. Referring to FIG. 3, the system 10 may be seen to include a generally cylindrical housing 30 having an internally threaded hole 32 at the bottom for receiving suitable fittings 34 (FIG. 1) which connect the system 10 to the passageway in the block 26 and which also mount the housing 30 to the block 26.

Immediately adjacent to the inner end of the hole 32 is a counterbore 36 which receives a porous disk 38 constituting a filter element which removes entrained particulates from hydraulic fluid passed therethrough. The disk may be formed of powdered metal and has a pore size of about 40 microns. Adjacent the counterbore 36 is a second counterbore 40 which tightly receives the lower portion of a cylindrical plug member 42 having first, second and third counterbored holes 44, 46 and 48 extending in mutual parallel relationship completely therethrough from top to bottom as the plug 42 is shown in FIG. 3. The bottoms of the three holes 44, 46 and 48 open directly onto the top of the filter element 38. The third hole 48 is counterbored and has a metering orifice 49 having a very small diameter of about 0.008 inch spaced from the upper and lower ends of the bore 48.

Mounted in the hole 44 is a check valve assembly including a solid ball 50, a coil spring 52 and a pair of set screws 54 and 56 having axial holes 54*a* and 56*a* extending respectively therethrough. The upper end portion of the hole 44 is counterbored and threaded to receive the screws 54 and 56. When assembled, the ball valve member 50 is biased against an annular valve seat provided by an annular shoulder 58 at the top of the counterbore in the bore 44. The set screws 54 and 56 are threadedly receive in the counterbore and the axial position of the set screw 54 in the hole 44 sets the pressure required to lift the ball 50 off the seat 58 to permit fluid to flow upwardly through the filter element 38 and through the holes 54*a* and 56*a* in the set screws 54 and 56 into the chambers 18*a* and 18*b*. The set screw 56 is used to lock the set screw 54 in the adjusted position. In like manner, a solid ball valve member 60, a coil spring 62, and a set screw 64 are positioned in the lower counterbored end portion of the hole 46 with the ball being resiliently biased upwardly against an annular valve seat 66 provided by an annular shoulder at the top of the counterbore. The axial position of the set screw 64 in the hole 46 sets the pressure required to push the ball 60 off the seat 62 to permit fluid to flow down through the hole 46 and through the hole 64*a* in the set screw 64 and through the filter element 38 and the passageway in the block 26 to the chambers 18*a* and 18*b*.

Above the counterbore 66 and adjacent thereto is a third counterbore 68 which provides a reservoir for containing a supply of hydraulic fluid for replacing any of the hydraulic fluid that has leaked from the chambers 18*a* and 18*b*. A piston-like cylindrical cover 70 floats on the surface of the hydraulic fluid in the counterbore 68. The cover 70 is provided with an annular groove in which a resilient O-ring gasket 72 is disposed in compressed relationship against the wall of the counterbore 68. The upper end of the housing 30 is provided with an external thread 74 which mates with the internal thread in a central bore in a cap 76. A tubular fitting 78 is mounted in a threaded hole in the center of the cap 76, and a sealing air valve cap 80 is adapted to be threadedly attached over the upper end of the fitting 78. A check valve of the type used in automotive tires is mounted in the fitting 78 to permit pressurizing of the space above the sliding cover 70 with air from a shop air line or directly from an air compressor. Normally, the space above the cover 70 is filled with air to a pressure of about 100 p.s.i.

During normal use of the torque resistance device 14, the pressure in the chambers 18*a* and 18*b* is between 200 and 300 p.s.i. The NPT threaded set screw 54 is set so that ball valve 50 opens when the pressure in the chambers 18*a* and 18*b* is at a predetermined pressure of between about 400 and 600 p.s.i. The set screw 64 is adjusted so that the ball valve 60 opens when the pressure in the reservoir is a few ounces greater than the pressure in the chambers 18*a* and 18*b* thereby to permit fluid to flow automatically from the reservoir to the chamber 18*a* and 18*b*.

As the hydraulic fluid in the chambers 18*a* and 18*b* is heated during use of the device 14, it expands. As a result, the hydraulic fluid may flow out of these chambers into the reservoir through the hole 48, and as the fluid in the chambers 18*a* and 18*b* subsequently cools and thus contracts, fluid may flow back from the reservoir into the chambers 18*a* and 18*b* through the hole 48. The pressure differentials required to cause fluid flow through the orifice 48 is very low, wherefore, under normal operating conditions the chambers 18*a* and 18*b* remain filled with hydraulic fluid at all times as hydraulic fluid is transferred back and forth between the reservoir and the chambers 18*a* and 18*b* through the orifice 48. In the event the orifice cannot handle the quantity of fluid flow necessary to prevent the formation of voids as the fluid in the chambers 18*a* and 18*b* cools, the reduction in pressure in the chambers 18*a* and 18*b* will cause the ball valve 60 to open and permit fluid to flow from the reservoir down through the hole 46 and the filter element 38 into the chambers 18*a* and 18*b*. Should hydraulic fluid leak out of the 18*a* and 18*b*, it is automatically replaced by fluid from the reservoir through the check valve including the ball 60 when the pressure differential between the reservoir and the chambers 18*a* and 18*b* falls below the value set by the set screw 64.

It may thus be seen that the system of the present invention allows heated fluid to move from the device 14 to the reservoir and then back to the device 14 on demand. The first movement of fluid from the device 14 is through the orifice 48 and if such flow is inadequate to prevent the formation of voids in the chambers 18*a* and 18*b* fluid moves through the relief valve. The reverse flow of fluid from the reservoir to refill the chambers 18*a* and 18*b* is through the refill valve in the hole 46. The pressures within system are thus balanced instantaneously upon demand and the system is always self compensating.

While the present invention has been described in connection with particular embodiments thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. A manually operable hydraulic torque resistance device comprising in combination first housing means sealably enclosing a generally cylindrical bore, stator means and manually rotatable radial vane means respectively mounted in said bore and dividing said bore into two pressure chambers located between the radial sides of said vane means and said stator means, second housing means defining a reservoir chamber therein for retaining a supply of liquid, a plug member mounted in said reservoir chamber, a liquid outlet port in said second housing means for carrying liquid between said reservoir chamber and said two pressure chambers, a first bypass conduit extending through said plug member and connected between said port and said reservoir chamber, first check valve means mounted in said bypass conduit and oriented to permit the flow of liquid from said reservoir chamber to said pressure chambers when the pressure in said reservoir chamber exceeds the pressure in said pressure chambers by a first predetermined value, a second bypass conduit extending through said plug member and connected between said port and said reservoir chamber, second check valve means mounted in said second bypass conduit and oriented to permit the flow of liquid from said pressure chambers to said reservoir chamber when the pressure in said pressure chambers exceeds the pressure in said reservoir chamber by a second predetermined value, a third bypass conduit means extending through said plug member and connected between said reservoir chamber and said pressure chambers, said third bypass conduit means providing a continuously open restrictive passage between said reservoir chamber and said pressure chambers, and orifice means disposed in said third bypass conduit to permit liquid to flow between said reservoir chamber and said pressure chambers as the volume of liquid in said pressure chambers expands and contracts as a result of temperature changes of said liquid in said pressure chambers, said first, second, and third bypass conduits being rectilinear holes which extend in spaced apart parallel relationship through said plug.

2. The combination according to claim 1, wherein said orifice means is disposed intermediate the ends of said third bypass conduit.

3. The combination according to claim 1 wherein said first and second check valve means include ball valve members respectively mounted in said first and second bypass conduits.

* * * * *

UNITED STATES PATENT AND TRADEMARK OFFICE

CERTIFICATE OF CORRECTION

PATENT NO. : 5,085,298
DATED : February 4, 1992
INVENTOR(S) : Phillip A. Sollami It is certified that error appears in the above—identified patent and that said Letters Patent is hereby corrected as shown below:

In column 2 at line 32, delete "18i" and substitute --18b--.

In column 2 at line 38, delete "chamber" and substitute --chambers--.

Signed and Sealed this
First Day of June, 1993

*Attest:*

*Attesting Officer*

Michael K. Kirk

MICHAEL K. KIRK

*Acting Commissioner of Patents and Trademarks*